US008240804B2

(12) United States Patent
Tanaka et al.

(10) Patent No.: US 8,240,804 B2
(45) Date of Patent: Aug. 14, 2012

(54) PRINTING APPARATUS AND PRINTING CONTROL METHOD

(75) Inventors: Hirokazu Tanaka, Kawasaki (JP); Hidehiko Kanda, Yokohama (JP); Susumu Hirosawa, Tokyo (JP); Wakako Yamamoto, Sagamihara (JP); Kenichi Oonuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 282 days.

(21) Appl. No.: 12/716,661

(22) Filed: Mar. 3, 2010

(65) Prior Publication Data

US 2010/0238226 A1 Sep. 23, 2010

(30) Foreign Application Priority Data

Mar. 18, 2009 (JP) ..... 2009-066326

(51) Int. Cl.
*B41J 29/38* (2006.01)
*B41J 2/175* (2006.01)
*B41J 2/00* (2006.01)

(52) U.S. Cl. ..... 347/17; 347/85; 347/189

(58) Field of Classification Search ..... None
See application file for complete search history.

(56) References Cited

U.S. PATENT DOCUMENTS

| | | | | |
|---|---|---|---|---|
| 5,646,655 | A | 7/1997 | Iwasaki et al. | |
| 5,760,797 | A | 6/1998 | Koizumi et al. | |
| 6,024,430 | A | 2/2000 | Koitabashi et al. | |
| 6,719,395 | B2 | 4/2004 | Iwasaki et al. | |
| 6,830,308 | B2 | 12/2004 | Hamasaki et al. | |
| 6,957,880 | B2 * | 10/2005 | Kawatoko et al. | 347/14 |
| 6,988,782 | B2 | 1/2006 | Imanaka et al. | |
| 7,325,896 | B2 * | 2/2008 | Koehler et al. | 347/17 |
| 2008/0165217 | A1 * | 7/2008 | Tanaka et al. | 347/17 |

FOREIGN PATENT DOCUMENTS

| | | |
|---|---|---|
| JP | 3-101942 | 4/1991 |
| JP | 6-336025 | 12/1994 |
| JP | 7-209031 | 8/1995 |
| JP | 2000-280455 | 10/2000 |
| JP | 2004-130688 | 4/2004 |

* cited by examiner

*Primary Examiner* — Stephen Meier
*Assistant Examiner* — Alexander C Witkowski
(74) *Attorney, Agent, or Firm* — Fitzpatrick, Cella, Harper & Scinto

(57) ABSTRACT

The present invention uses a temperature sensor to sense the temperature of a print head configured to eject ink, and senses the environmental temperature of a printing apparatus. The temperature of the print head is corrected based on the environmental temperature only if information from the temperature sensor is different from the last information acquired.

8 Claims, 9 Drawing Sheets

| DIODE SENSOR RANK | FuseROM bit EXPRESSION | OFFSET ERROR Di_offset |
|---|---|---|
| 0 | 0000 | -16 ℃ ≦ Di_offset ≦ -14 ℃ |
| 1 | 0001 | -14 ℃ < Di_offset ≦ -12 ℃ |
| 2 | 0010 | -12 ℃ < Di_offset ≦ -10 ℃ |
| 3 | 0011 | -10 ℃ < Di_offset ≦ -8 ℃ |
| 4 | 0100 | -8 ℃ < Di_offset ≦ -6 ℃ |
| 5 | 0101 | -6 ℃ < Di_offset ≦ -4 ℃ |
| 6 | 0110 | -4 ℃ < Di_offset ≦ -2 ℃ |
| 7 | 0111 | -2 ℃ < Di_offset ≦ 0 ℃ |
| 8 | 1000 | 0 ℃ < Di_offset ≦ +2 ℃ |
| 9 | 1001 | +2 ℃ < Di_offset ≦ +4 ℃ |
| 10 | 1010 | +4 ℃ < Di_offset ≦ +6 ℃ |
| 11 | 1011 | +6 ℃ < Di_offset ≦ +8 ℃ |
| 12 | 1100 | +8 ℃ < Di_offset ≦ +10 ℃ |
| 13 | 1101 | +10 ℃ < Di_offset ≦ +12 ℃ |
| 14 | 1110 | +12 ℃ < Di_offset ≦ +14 ℃ |
| 15 | 1111 | +14 ℃ < Di_offset ≦ +16 ℃ |

FIG.4

PRINTING APPARATUS AND PRINTING CONTROL METHOD

BACKGROUND OF THE INVENTION

1. Field of the Invention

The present invention relates to a printing apparatus and printing control method, and in particular, to a printing apparatus including temperature sensing means for a print head, and a printing control method.

2. Description of the Related Art

A thermal ink jet printing method (hereinafter also referred to as an ink jet printing method) performs printing by energizing heaters to generate heat energy, thus generating bubbles in ink. In an inkjet printing apparatus, ink ejection amount (the volume of ink pushed out through nozzles) and ink ejection speed are significantly affected by the temperature of the ink (hereinafter also referred to as the ink temperature) near the heaters. An increase in ink temperature increases the ink ejection amount and the ink ejection speed. On the other hand, a decrease in ink temperature reduces the ink ejection amount and the ink ejection speed.

A change in ink ejection amount changes the density of an output image. Furthermore, a change in ink ejection speed changes an ink attachment position on a print medium. As a result, a density distribution may occur in the printed image, thus degrading print quality.

Thus, for the ink jet printing apparatus, an ink ejection control technique for allowing ink to be ejected constantly with respect to the ink temperature serves to improve the print quality. For the constant ejection with respect to the ink temperature, it is important to control the temperature of a print head by accurately determining the ink temperature.

However, directly sensing the ink temperature is difficult. Hence, the temperature of a print head board (hereinafter also referred to as the print head temperature) is commonly sensed so that ink ejection control and print head thermoregulation control are performed based on the sensed temperature. As a sensor for sensing the print head temperature, a diode sensor is often used which is formed on the same silicon chip on which ejection heaters are formed. This is because the diode sensor is manufactured by film formation and thus requires reduced costs and because the diode sensor is formed on an Si substrate with a high heat conductivity and thus offers high responsiveness.

The diode sensor does not involve a significant manufacturing variation in a proportionality coefficient (hereinafter also referred to as an inclination) for the temperature and output voltage. However, the diode sensor involves a great variation in output voltage value at a constant temperature (hereinafter also referred to as a zero intercept or an offset). Thus, maintaining the variation within an allowable range during actual use is relatively difficult. Consequently, processing may be executed to calibrate the offset. For example, the following are stored: a temperature (Tdef) corresponding to a voltage value obtained if the temperature of the print head has not been increased and is equivalent to the room temperature, and the room temperature (Tr) obtained by a thermistor in the printing apparatus main body. The offset value Tadj of the diode sensor in the print head is:

$$Tadj=Tr-Tdef.$$

Hence, given that the temperature corresponding to the voltage value of the head diode sensor in a certain state is Tdi, the print head temperature (Th) can be obtained by:

$$Th=Tdi+Tadj.$$

However, if the print head with the increased temperature is re-replaced (the print head is removed from the printing apparatus and then re-installed therein) or a user performs the operation of repeatedly powering on and off the printing apparatus main body, the temperature of the print head may be higher than the room temperature. In this case, the temperature Tdef, which corresponds to the reference temperature of the head indicated by the diode sensor, may be set to an incorrect value.

For example, Japanese Patent Application Laid-Open No. H07-209031 (1995) discloses a technique to obtain a more accurate offset value by updating the print head temperature a predetermined time after the calibration of the temperature during power-on or head installation.

However, in the technique disclosed in Japanese Patent Application Laid-Open No. H07-209031 (1995), if there is a difference between the actual temperature of the print head and the environmental temperature of the printing apparatus immediately after power-on or head installation, an incorrect correction value may be acquired. In particular, if the actual temperature of the print head is higher than the environmental temperature of the printing apparatus as in the above-described example, correction may be performed based on a numerical value deviating from the accurate correction value. For example, in case that correction is performed when the actual temperature of the print head is higher than the environmental temperature of the printing apparatus, the printing apparatus determines that the print head temperature is low, though the temperature is actually high. Thus, continuing a printing operation may excessively increase the print head temperature.

The present invention has been developed in view of the above-described problems. An object of the present invention is to provide a printing apparatus and a printing control method which allow the temperature sensor for the print head to be quickly and accurately calibrated even if the print head is assumed to have been replaced, for example, immediately after power-on or head installation.

SUMMARY OF THE INVENTION

To accomplish the above-described object, the present invention provides a printing apparatus configured to perform printing using a print head configured to eject ink, the apparatus comprising first sensing means for sensing a temperature of the print head using a temperature sensor provided in the print head, second sensing means for sensing an environmental temperature of the printing apparatus, acquisition means for acquiring information on a property of the temperature sensor held in a memory for the print head, at a predetermined timing, and correction means for correcting the temperature of the print head sensed by the first sensing means based on the environmental temperature sensed by the second sensing means only if the information acquired by the acquisition means is different from the information acquired at a preceding timing.

According to the above-described configuration, the temperature sensor for the print head can be quickly and accurately calibrated even if the print head has presumably been replaced, for example, immediately after power-on or head installation.

Further features of the present invention will become apparent from the following description of exemplary embodiments (with reference to the attached drawings).

BRIEF DESCRIPTION OF THE DRAWINGS

FIG. 4 is a diagram showing a table for a diode sensor rank and an offset error according to the embodiment of the present invention;

DESCRIPTION OF THE EMBODIMENTS

An embodiment of the present invention will be described below in detail with reference to the drawings.

Figure 1A:
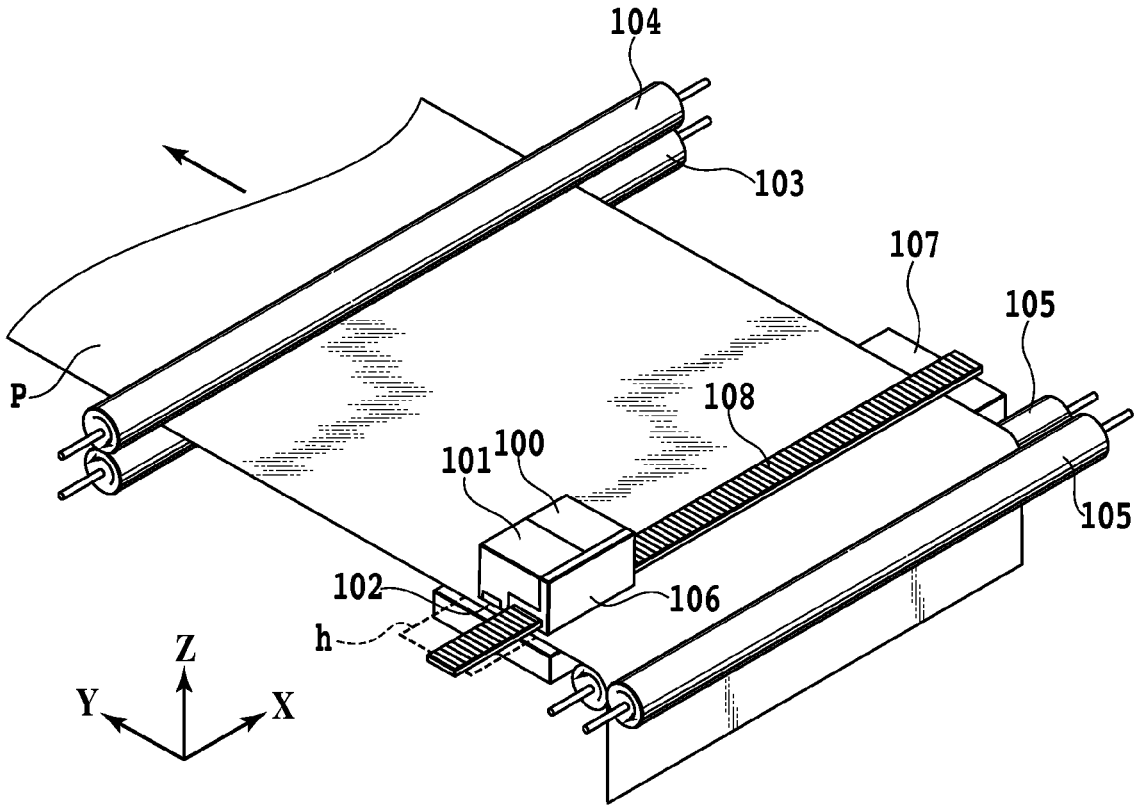
FIGS. 1A and 1B are diagrams schematically showing a printing apparatus according to an embodiment of the present invention.
Figure 1B:
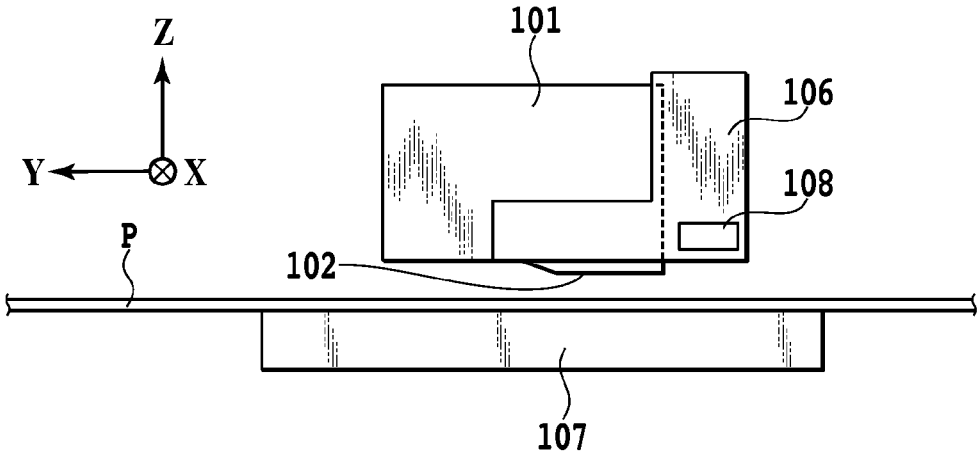

FIGS. 1A and 1B are diagrams schematically showing a printing apparatus according to the present embodiment. FIG. 1A is a perspective view showing an ink jet printing apparatus. FIG. 1B is a sectional view showing a Y-Z cross-section of a print head 101.

A print head 100 is integrated with an ink tank configured to accommodate black ink, light cyan ink, and light magenta ink. The print head 101 is integrated with an ink tank configured to accommodate cyan ink, magenta ink, and yellow ink. Each of the print heads 100 and 101 includes a plurality of ejection ports 102 arranged in association with each of the inks.

A conveying roller 103 and an auxiliary roller 104 rotate in the directions of arrows in FIG. 1A while cooperating in pressing a print medium P, thus conveying the print medium P in a sub-scanning direction (Y direction in FIG. 1A) as required. A sheet feeding roller 105 conveys the medium P and also serves to press the print medium P like the conveying roller 103 and the auxiliary roller 104.

A carriage 106 supports and moves the print heads 100 and 101 in a main scanning direction (in FIG. 1A, an X direction) along a carriage belt 108 during printing. The carriage 106 stands by at a home position (h) (position shown by a dotted line in FIG. 1A) while printing is not performed or when an operation of recovering the print head is performed. A platen 107 serves to stably support the print medium P at a print position.

Figure 2A:
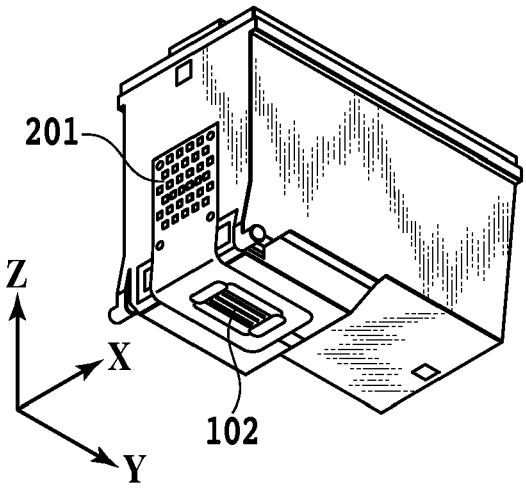
FIGS. 2A to 2C are diagrams schematically showing the configuration of a print head according to the embodiment of the present invention.
Figure 2B:
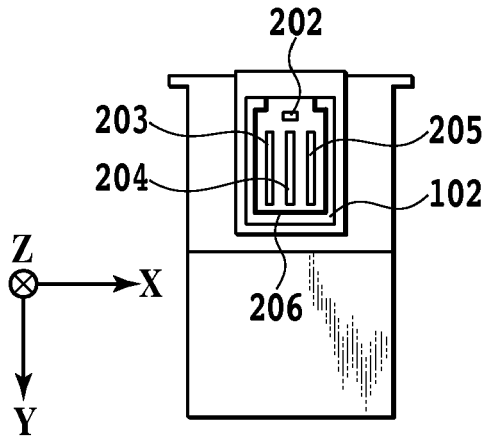
Figure 2C:
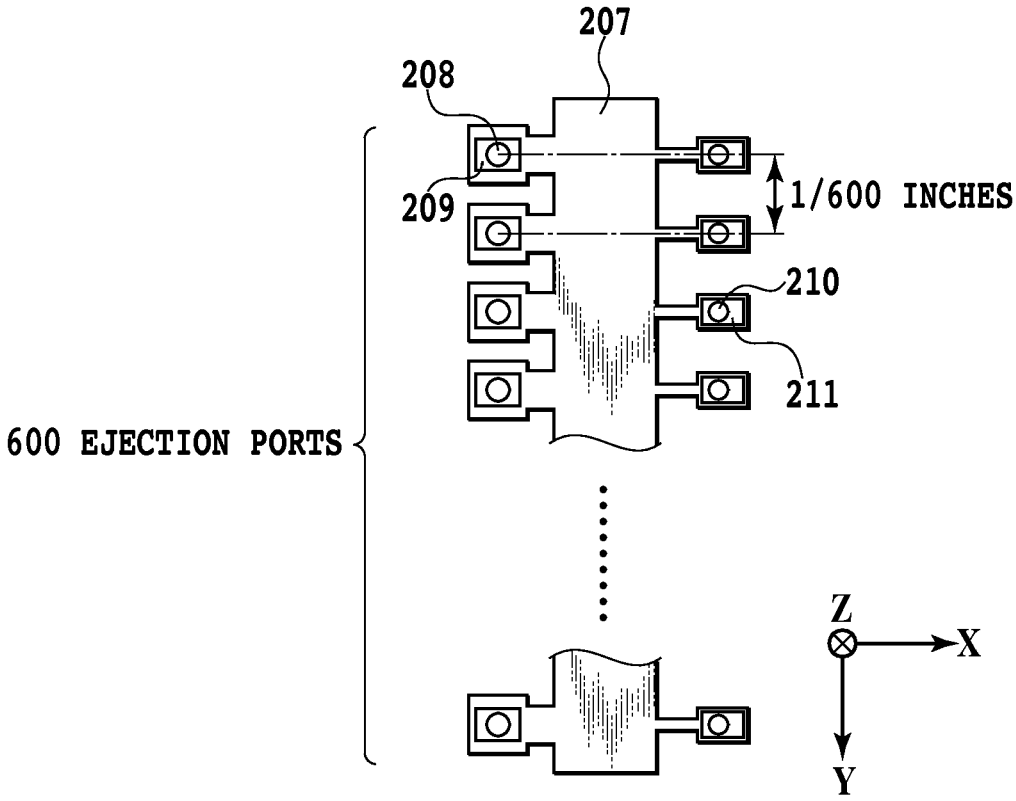

FIGS. 2A to 2C are diagrams schematically showing the configuration of the print head 101 according to the present embodiment. The print heads 100 and 101 have the same structure. Thus, the configuration of the print head 100 will not be described. FIG. 2A is a perspective view showing the print head 101. FIG. 2B is a bottom view of the print head 101 as viewed in a Z direction. FIG. 2C is an enlarged view showing an ejection port row 203 for cyan ink in the print head 101.

The print head 101 receives a print signal from the printing apparatus main body via a contact pad 201. The print head 101 is supplied with power required to drive the print head. A diode sensor 202, an ejection port row 203, an ejection port row 204, and an ejection port row 205 are arranged on a print chip 102; the diode sensor 202 senses the temperature of a print head board, cyan ink is ejected through the ejection port row 203, magenta ink is ejected through the ejection port row 204, and yellow ink is ejected through the ejection port row 205. Furthermore, an ink heating sub-heater 206 with a resistance of 100Ω is located so as to surround the ejection port rows 203, 204, and 205. The sub-heater 206 heats or avoids heating the print head board depending on whether or not a voltage of 20 V is applied to the sub-heater 206. This allows the temperature of the print head (ink temperature) to be adjusted. Based on temperature information obtained by the diode sensor 202, serving as print head temperature sensing means, and a thermistor 315 (see FIG. 3), serving as environmental temperature sensing means, the printing apparatus according to the present embodiment performs feedback control by switchably heating and avoiding heating the print head board so that the print head temperature approaches an adjustment temperature.

FIG. 2C is an enlarged view of the ejection port row 203 through which cyan ink is ejected. A row of ejection ports 208 through which 5 pl of ink is ejected and a row of ejection ports 210 through which 2 pl of ink is ejected are arranged on the respective opposite sides of an ink liquid chamber 207. A 5-pl ejection heater 209 with a resistance value of 500Ω is located immediately below the nozzle of the ejection port 208 (on a +Z direction side). A 2-pl ejection heater 211 with a resistance value of 700Ω is located immediately below the nozzle of the ejection port 210 (on the +Z direction side). Upon receiving a voltage of 20 V, the heaters 209 and 211 generate heat and thus bubbles, thus allowing ink to be ejected through the respective nozzles. The numbers of the ejection ports 208 and 211 are each 600. The ejection ports 208 and 210 are spaced at intervals of 1/600 inches. Thus, the print head according to the present embodiment is configured to offer a print pixel density of 600 dpi. Furthermore, the heaters 209 and 211 have an ejection frequency of 24 kHz in order to allow ink droplets to be stably ejected.

If droplets are printed at intervals of 1,200 dpi in the main scanning direction, the speed at which the carriage with the print heads 100 and 101 mounted thereon moves in the main scanning direction is 24,000 (dots/sec)÷1,200 (dots/inch)=20 inches/sec. In connection with ink properties, the same ejection property, that is, ejection amount or ejection speed with respect to temperature, is offered to the black ink, light cyan ink, light magenta ink, cyan ink, magenta ink, and yellow ink accommodated in the print heads 100 and 101. In the present embodiment, the optimum print condition is such that the ink ejection speed is 15 m/s for both the ink ejection amounts of 5 pl and 2 pl. The ink temperature that meets this condition is 50° C. At 30° C. or lower, the ink ejection speed may be low and insufficient to allow the ink to reach the print medium, thus degrading print quality. Furthermore, when the ink temperature is about as low as the room temperature (about 25° C.), the ink may be too viscous to be ejected. On the other hand, at a high temperature of at least 70° C., the ink ejection amount increases excessively, resulting in insufficient ink supply for ejection and thus improper ejection.

Figure 3:
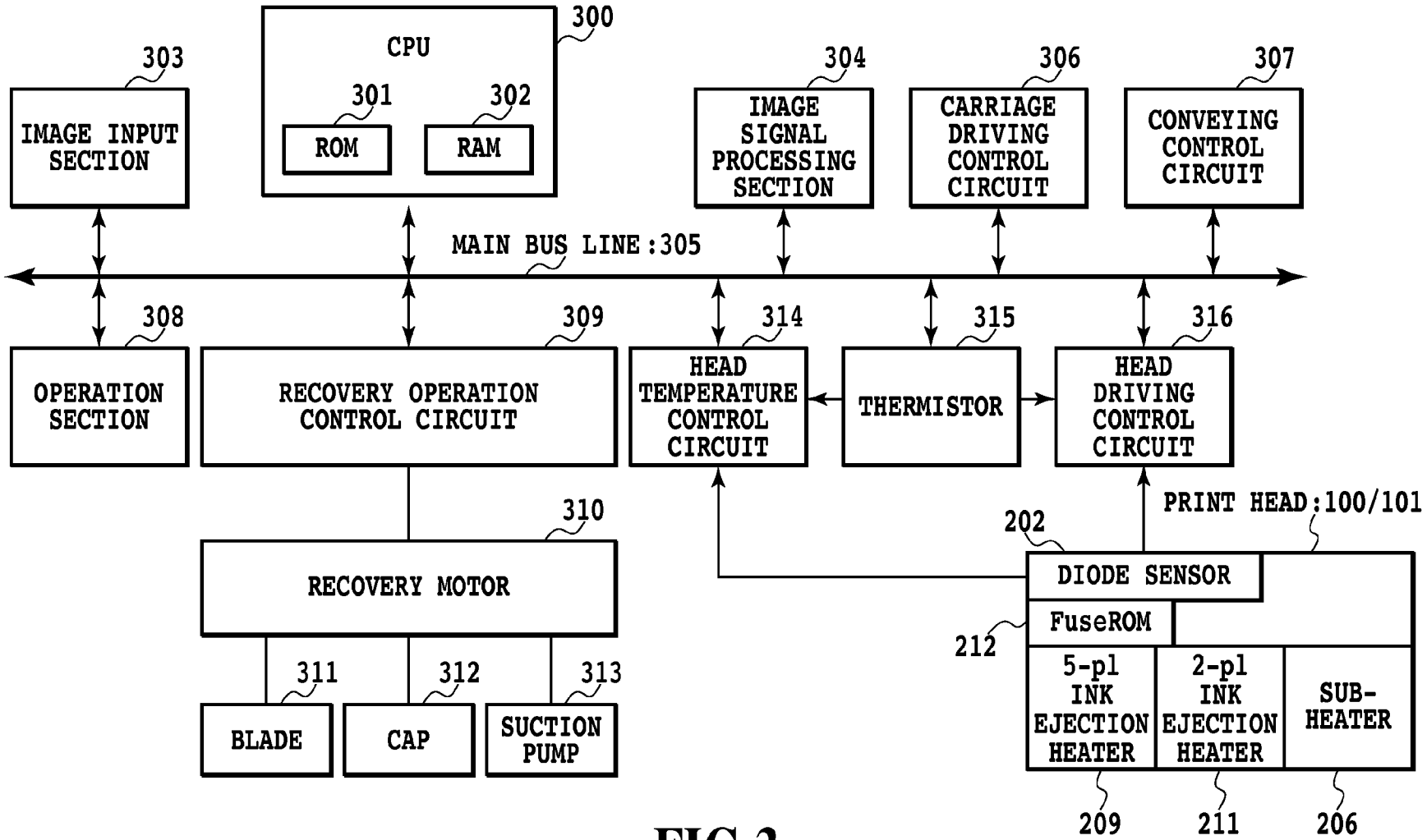
FIG. 3 is a block diagram showing a control arrangement in the printing apparatus according to the embodiment of the present invention.

FIG. 3 is a block diagram showing a control arrangement in the printing apparatus according to the present embodiment. The components of the present control arrangement can be roughly classified into software control means and hardware control means. The software control means includes an image input section 303 and corresponding processing means such as an image signal processing section 304 and a central control section CPU 300; the image input section 303, the image signal processing section 304, and the central control section CPU 300 each access a main bus line 305. The hardware processing means includes processing means such as an operation section 308, a recovery operation control circuit 309, a head temperature control circuit 314, a head driving control circuit 316, a main scanning-direction carriage driving control circuit 306, and a sub-scanning-direction conveying control circuit 307.

The CPU 300 normally includes a ROM 301 and a RAM 302. The CPU 300 allows printing to be performed by offering appropriate print conditions for input information to drive the ink ejection heaters 209 and 211 in each of the print heads 100 and 101. Furthermore, a program that executes a recovery timing chart for the print heads is pre-stored in the RAM 302. The program offers recovery conditions such as a preliminary ejection condition to the recovery operation control circuit 309, the print heads 100 and 101, and the like as required. A recovery motor drives the print heads 100 and 101, and a cleaning blade 311, a cap 312, and a suction pump 313 which are arranged opposite and away from the print heads 100 and 101. The head temperature control circuit 314 determines driving conditions for the sub-heater 206 on the print heads 100 and 101 based on output values from the thermistor 315, configured to sense the environmental temperature, the ambient temperature of the print heads, and the diode sensor 202, configured to sense the print head temperature. The driving control circuit 316 drives the head sub-heater 206 based on the determined driving conditions. The head driving control circuit 316 also drives the 5-pl ink ejection heater 209 and 2-pl ink ejection heater 211 on each of the print heads 100 and 101. The heaters 209 and 211 are driven to allow the print heads 100 and 101 to perform preliminary ejection, ink ejection, and adjustment of the ink temperature for thermoregulation control.

A program that executes thermoregulation control is stored in, for example, the RAM 302 to allow sensing of the print head temperature, driving of the sub-heater 206, and the like to be performed via the head temperature control circuit 314, the head driving control circuit 316, and the like. The head driving control circuit 316 can also perform PWM control by using a driving signal composed of a pre-pulse and a main pulse to drive the ink ejection heater 207.

A fuse ROM 212 is configured to store property values for the print heads based on a combination of blown and unblown conditions of fuses. Recorded print head properties are roughly classified into two types, those written to the fuse ROM 212 during a manufacturing process for the print head and those written to the fuse ROM 212 on the printing apparatus. The print head properties written during the manufacturing process include a destination number indicative of the destination of the print head, a 5-pl ejection pulse number required to select the optimum pulse for the 5-pl nozzle, and a 2-pl ejection pulse number required to select the optimum pulse for the 2-pl nozzle. The print head properties further include a manufacturing number indicative of a manufacture date and time and a diode sensor rank indicative of the range of the offset value of the diode sensor, which corresponds to a characteristic value inherent in the print head. The print head properties written on the printing apparatus include an ink remaining amount rank indicative of the range of the amount of ink remaining.

The information capacity of the fuse ROM 212 is 24 bits for both the print heads 100 and 101. Of the 24 bits, 3 bits are for the destination number, 4 bits are for the 5-pl ejection pulse number, and 4 bits are for the 2-pl ejection pulse 4 bits are for the diode sensor rank, and 5 bits are for the ink remaining amount rank.

FIG. 4 is a diagram showing the diode sensor rank and an offset error Di_offset according to the present embodiment. That is, FIG. 4 shows a table indicative of the relationship between the rank of the diode sensor and the offset value of the value output at a predetermined environmental temperature by the diode sensor, serving as print head temperature sensing means.

In the present embodiment, in the same environment, the offset error Di_offset, a characteristic value resulting from a manufacturing variation in the diode sensor, is between 16° C. and −16° C. The offset error Di_offset is ranked using 4 bits. At the same rank, the output from the diode sensor is within the error range of 2° C. In the present embodiment, individual identification information (ID) on the print heads is not written to the fuse ROM 212 in connection with the storage capacity. Furthermore, in the present embodiment, the offset error Di_offset is between +16° C. and −16° C., and is ranked using 4 bits. Thus, the total number of ranks is 16, and the range is 2° C. However, the present invention is not limited to this aspect. That is, the range of the offset error Di_offset may be set in accordance with the environment. The total number of ranks is determined by the accuracy required for the printing apparatus.

Now, print head temperature acquisition control according to the present embodiment will be described in detail.

Figure 5:
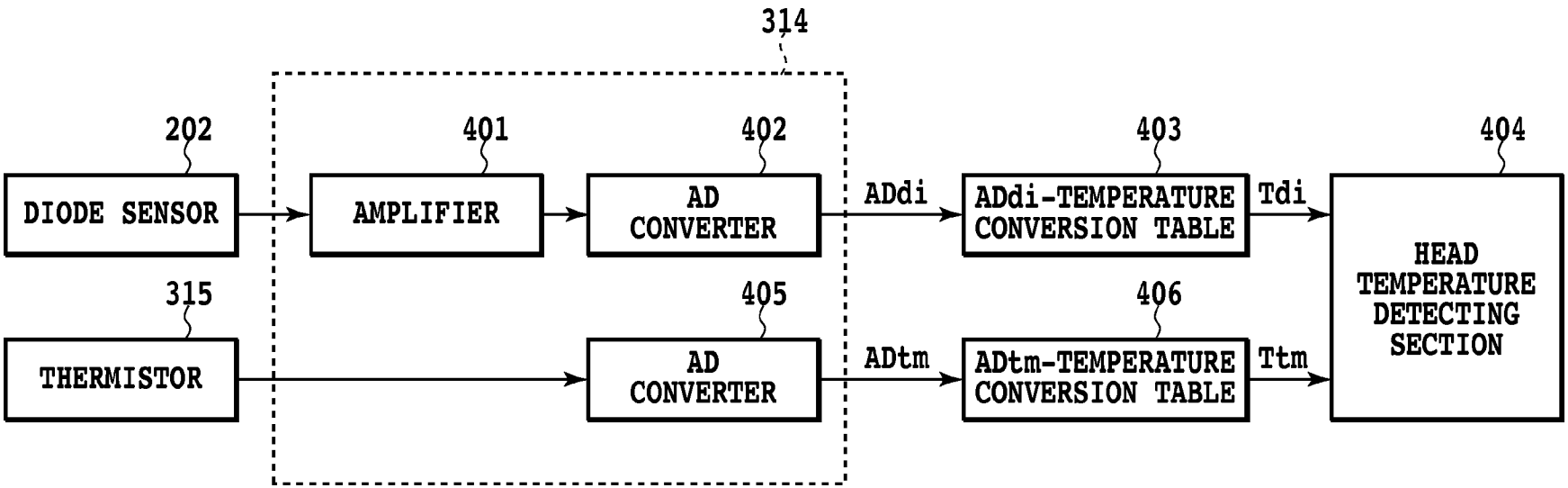
FIG. 5 is a block diagram showing the flow of processing in a head temperature control circuit and processing executed on software through ROM/RAM according to the embodiment of the present invention.

FIG. 5 is a block diagram showing the flow of processing in the head temperature control circuit 314 and processing executed on the software through the ROM 301/RAM 302. When the diode sensor 202, provided in each of the print heads 100 and 101, inputs a voltage based on the print head temperature to the head temperature control circuit 314, an amplifier 401 amplifies the voltage value. The amplified voltage value is digitalized by an AD converter 402. The digitalized diode sensor voltage value ADdi is converted into a diode temperature Tdi based on an ADdi-temperature conversion table 403 in the ROM 301. On the other hand, when the thermistor 315 inputs a voltage based on the environmental temperature of the printing apparatus, to the head temperature control circuit 314, an AD converter 405 digitalizes the voltage value. The digitalized thermistor value ADtm is converted into a thermistor temperature Ttm based on an ADtm-temperature conversion table 406 in the ROM 301. The diode temperature Tdi and thermistor temperature Ttm thus obtained are input to a head temperature detecting section 404. The head temperature detecting section 404 uses the thermistor temperature Ttm to set an offset value for the diode temperature Tdi, thus acquiring the print head temperature.

Figure 6:
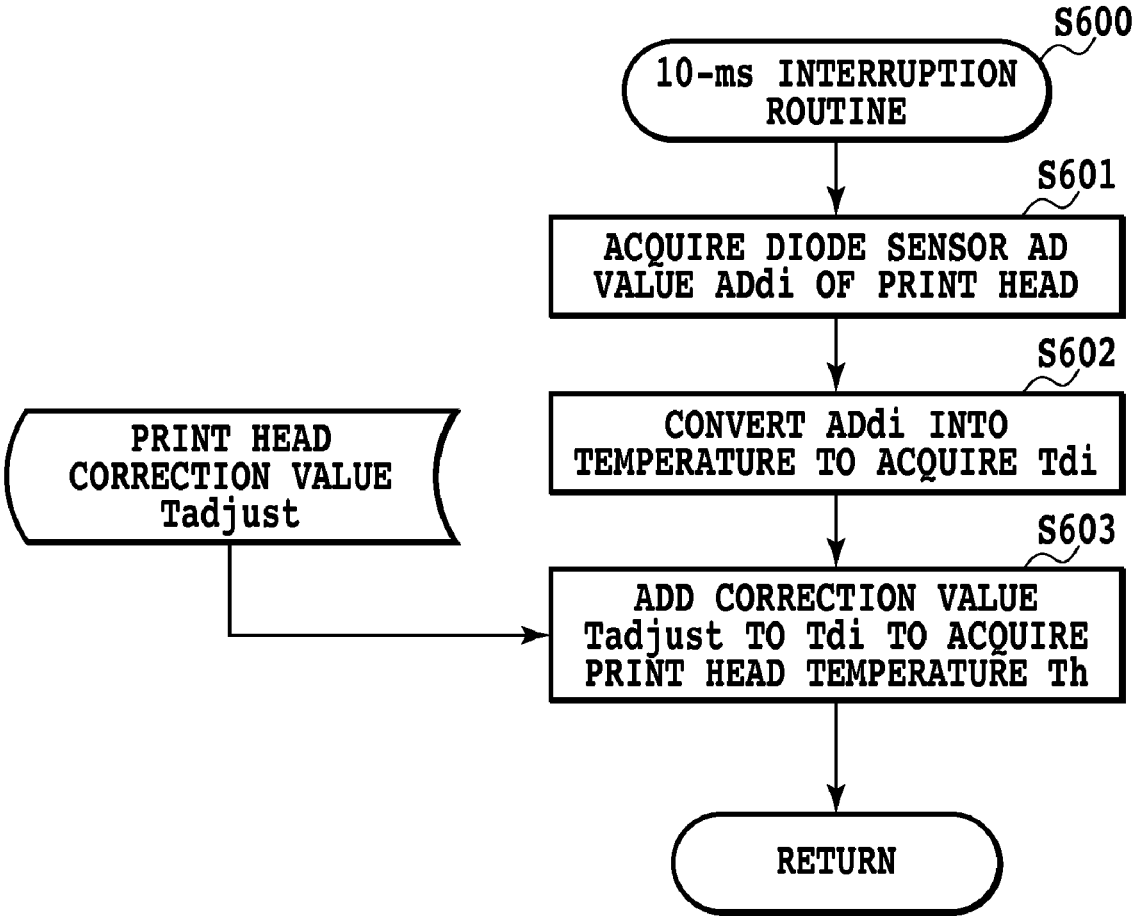
FIG. 6 is a flowchart showing an operation of acquiring the temperature of the print head according to the embodiment of the present invention.
Figure 7:
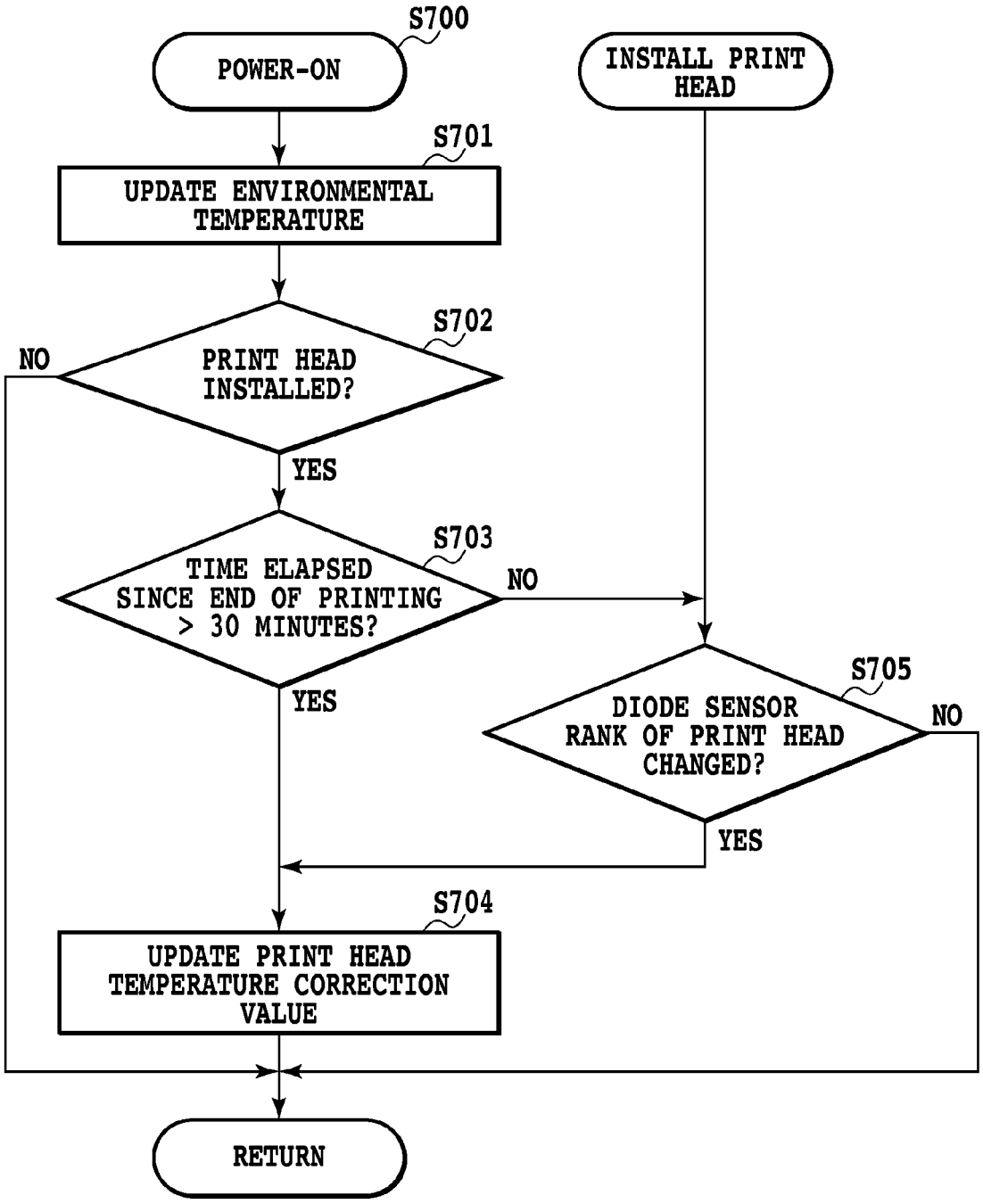
FIG. 7 is a flowchart showing an operation of acquiring a print head temperature correction value according to the embodiment of the present invention.

FIG. 6 is a flowchart showing an operation of acquiring the print head temperature according to the present embodiment. When the printing apparatus is powered on, an interruption routine is executed at intervals of 10 ms (S600). The diode sensor 202 in the print head acquires the diode sensor AD value ADdi (S601). Then, the diode sensor ADdi-temperature conversion table in the ROM 301 is used to convert the diode sensor AD value ADdi into the diode temperature Tdi (S602). Then, a print head temperature correction value Tadjust for the print head described below with reference to FIG. 7 is added to the diode sensor AD value ADdi to acquire the print head temperature Th (S603). The print head temperature Th acquired is updated 10 ms later in accordance with the above-described flow. The temperature acquisition control allows the apparatus to determine whether the thermoregulation control according to the present embodiment is performed at intervals of 10 ms and sets the temperature to at least 50° C.

The temperature acquisition control further controllably turns on and off the sub-heater 206 at a resolution of 10 ms.

Now, a method for acquiring the print head temperature correction value Tadjust will be described.

FIG. 7 is a flowchart showing an operation of acquiring the print head temperature correction value Tadjust. When the printing apparatus is powered on (S700), the environmental temperature is updated (S701). The environmental temperature is updated by allowing the head temperature detecting section 404 to acquire the thermistor temperature Ttm, setting the acquired value to be an environmental temperature, and storing the environmental temperature Tenv in the RAM 302 on the printing apparatus. Then, the apparatus determines whether or not a print head has been installed therein (S702). If no print head is installed in the printing apparatus, the process is ended with no temperature correction value acquired. On the other hand, if a print head has been installed, the apparatus determines whether or not the time elapsed since the end of the last printing is longer than a predetermined time (S703). The predetermined time according to the present invention is 30 minutes. If the time elapsed since the end of printing is longer than the predetermined time, the print head temperature correction value is updated (S704) to set the offset value. On the other hand, if the time elapsed since the end of printing is shorter than the predetermined time, the apparatus determines whether or not the diode sensor rank written to the fuse ROM 212 on the print head has been changed from the last recorded value (S705). If the diode sensor rank has been changed, the print head temperature correction value Tadjust is updated (S704) to set the offset value. If the diode sensor rank remains unchanged, the process is ended without the need to update the print head temperature correction value Tadjust.

Furthermore, if a print head is installed, the apparatus determines whether or not the diode sensor rank written to the fuse ROM 212 on the print head has been changed (S705). If the diode sensor rank has been changed, the print head temperature correction value Tadjust is updated (S704) to set the offset value. If the diode sensor rank remains unchanged, the process is ended without the need to update the print head temperature correction value Tadjust.

Now, the acquisition of the print head temperature correction value Tadjust will be described with reference to a specific example according to the present embodiment.

If the temperature correction value is acquired for the first time after shipment, then the process is ended in step S702 until a print head is installed in the printing apparatus, because in the present embodiment, the printing apparatus is shipped without a print head mounted therein. On the other hand, when a print head is installed, the determination in step S705 is performed. In this case, if for example, the diode sensor rank of the print head is 7 (see FIG. 4), since no recorded diode sensor rank is present immediately after shipment of the printing apparatus, the apparatus determines that the diode sensor rank is changed when the print head is installed. Thus, the diode sensor rank is stored in the ROM 301 of the printing apparatus. At the same time, the temperature correction value is updated to set the offset value (S704). The temperature correction value is updated by the head temperature detecting section 404 by acquiring the diode temperature Tdi. In general, before the temperature signal is acquired, noise components are desirably removed by software processing such as moving average. Then, the diode temperature Tdi is subtracted from the environmental temperature Tenv acquired in step S701 to obtain the print head temperature correction value Tadjust. That is, the following expression is given.

$$Tadjust = Tenv - Tdi$$

If the print head temperature correction value Tadjust exceeds +16° C., it is assumed that that print head temperature is not equal to the environmental temperature. Thus, if Tadjust≧+16° C., Tadjust=+16° C. is set in order to reduce erroneous corrections. If Tadjust≦−16° C., Tadjust=−16° C. is also set. The thus determined print head temperature correction value Tadjust is stored in the RAM 32 and used to acquire the print head temperature as shown in FIG. 6.

Now, replacement of the print head will be described. When an already mounted print head is removed and a new print head is installed, the apparatus determines whether or not the diode sensor rank written to the fuse ROM 212 on the print head has been changed from the last recorded rank (S705). If the new print head diode sensor rank is different from last recorded rank, that is, if the last recorded diode sensor rank is not 7, then the print head temperature correction value is updated (S704) to set the offset value. Furthermore, if the diode sensor rank is the same as the last recorded value, that is, if the diode sensor rank is 7, then the print head temperature correction value is not updated. In this case, the accuracy of the diode temperature between the old and new print heads is 2° C., which is within the in-rank offset error range. Hence, an accurate print head temperature correction value can be used without the need for updating. On the other hand, if a print head previously used is re-installed instead of a new print head, the print head, which has been hot owing to the thermoregulation control, that is, which has a temperature different from the environmental one, is installed.

In the prior art, in this case, the print head temperature correction value is updated. This may result in the acquisition of an incorrect print head temperature correction value. Even if the offset error of the diode sensor in the print head is 0° C., the actual temperature 35° C. of the print head and the environmental temperature 20° C. cause the print head temperature correction value −15° C. to be set. In this case, the thermoregulation control is actually performed at 65° C., though the target temperature is 50° C. As a result, ink is unstably ejected, thus degrading the print quality.

However, in the present embodiment, if the print head is re-installed, the diode sensor rank is 7, which is the same as the last recorded rank. This avoids updating the print head temperature correction value, preventing possible erroneous corrections.

Now, a printing method for the print head in the printing apparatus according to the present embodiment will be described.

Figure 8:
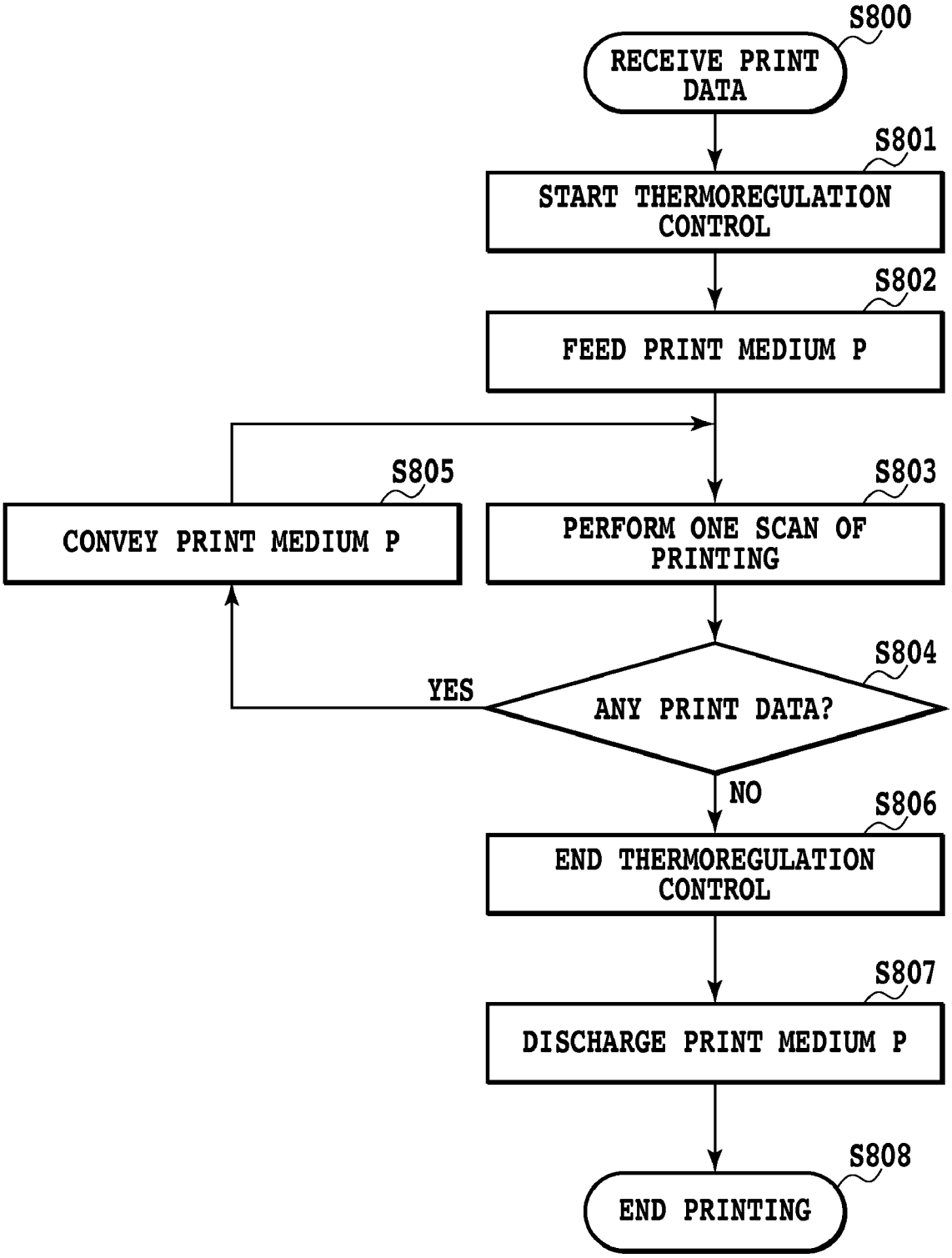
FIG. 8 is a flowchart showing a printing operation performed when printing control is carried out by the print head according to the embodiment of the present invention.

FIG. 8 is a flowchart showing printing control during printing performed by the print head 101 using cyan ink, magenta ink, and yellow ink.

Upon receiving print data (S800), the printing apparatus starts performing thermoregulation control on the print head (S801). The thermoregulation control according to the present embodiment involves acquiring the print head temperature Th corrected using the print head temperature correction value Tadjust, based on the diode sensor 202, provided in each of the print heads 100 and 101 (S603 in FIG. 6). In the present embodiment, if the print head temperature of the print head 100, 101 is lower than 50° C., the print head is heated by applying a voltage of 20 V to the sub-heater 206 in the print head. On the other hand, if the print head temperature of the print head 100, 101 is at least 50° C., no voltage is applied to the sub-heater 206.

Thermoregulation control is started (S801). A print medium P is fed (S802). The carriage 106 is moved in the +X direction to perform one scan of printing (S803). When the one scan of printing is finished, the apparatus determines whether or not any print data remains (S804). If any print data remains, the print medium P is conveyed in the +Y direction to a position where the print medium P is to be printed (S805). Printing is then performed by moving the carriage 106 in the −X direction so that the scanning direction is alternately reversed (S803). When the one scan of printing is finished, the apparatus determines whether or not any print data remains (S804). If no print data remains, the thermoregulation control is ended (S806). The print medium P is discharged (S807). Printing is then ended (S808).

As described above, the offset value setting means determines whether or not to set the offset value, in accordance with the characteristic value from the print head temperature sensing means. Thus, even if the print head is assumed to have been replaced, for example, immediately after power-on or head installation, the temperature sensor in the print head can be quickly and accurately calibrated.

In the example in the above described present embodiment, the printing apparatus stores the print head diode sensor rank of the last print head mounted in the apparatus and the correction value acquired while the last print head is mounted in the printing apparatus. The printing apparatus then references the correction value. However, the present invention is not limited to this aspect if the printing apparatus includes an extra print area. The printing apparatus may store the correction values for all the print heads with the different print head diode sensor ranks previously mounted in the printing apparatus.

Figure 9:
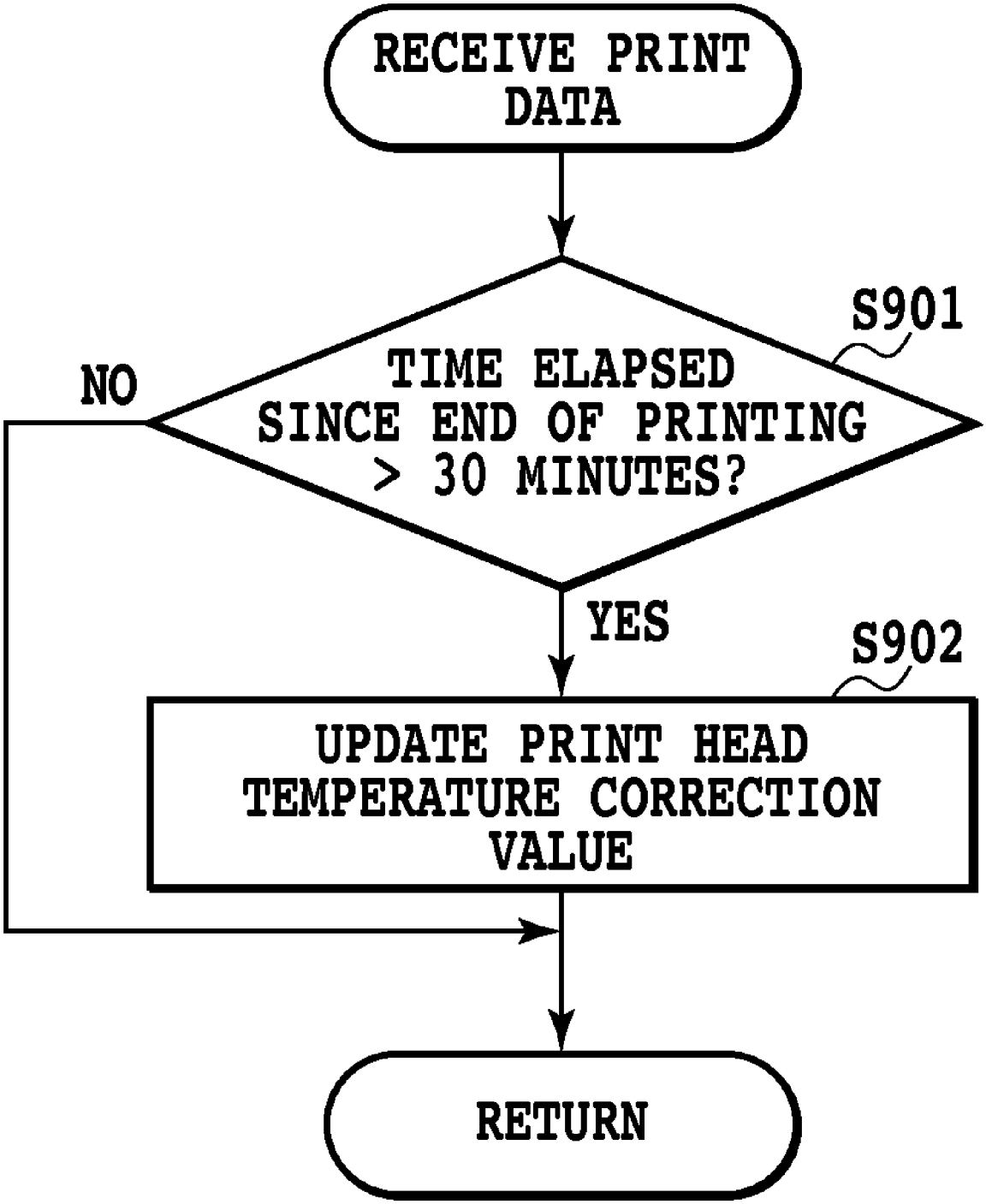
FIG. 9 is a flowchart showing an operation of acquiring another print head temperature correction value according to the embodiment of the present invention.

Furthermore, according to the present invention, if the thermoregulation control is interrupted and when the temperature of the hot print head becomes equal to the environmental temperature after the passage of a long time, the print head correction value may be updated. For example, the print head temperature correction value may always be updated when the time elapsed since the end of the last printing is determined to be at least a predetermined time, even if the print head has not been replaced during power-off. Furthermore, as shown in FIG. 9, the print head correction value may be updated when the time elapsed since the end of the last printing is determined to be at least the predetermined time before the start of printing following reception of print data (S901), even if the print head has not been replaced (S902).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-066326, filed Mar. 18, 2009, which is hereby incorporated by reference herein in its entirety.

What is claimed is:

1. A printing apparatus comprising:

a print head configured to eject ink, the print head being removably installed in the printing apparatus and having a temperature sensor and a memory holding information on a property of the temperature sensor;

first sensing means for sensing a temperature of the print head using the temperature sensor;

second sensing means for sensing an environmental temperature of the printing apparatus;

acquisition means for acquiring information on the property of the temperature sensor from the memory, at a predetermined timing; and correction value acquisition means for acquiring a correction value to correct the temperature of the print head sensed by the first sensing means, by comparing the temperature of the print head sensed by the first sensing means with the environmental temperature sensed by the second sensing means, wherein the correction value acquisition means does not acquire the correction value if first information acquired by the acquisition means after the print head is installed is the same as second information acquired by the acquisition means before the print head is installed.

2. The printing apparatus according to claim 1, wherein the information on the property of the temperature sensor is a rank determined based on a value output by the temperature sensor at a predetermined environmental temperature.

3. The printing apparatus according to claim 1, wherein the temperature sensor is a diode sensor.

4. The printing apparatus according to claim 1, wherein if installation of the print head is sensed after a predetermined time elapsed since end of printing, the correction value acquisition means acquires the correction value even if the first information is the same as the second information.

5. The printing apparatus according to claim 1, wherein the acquisition means acquires the information when the printing apparatus is powered on or when the print head is installed in the printing apparatus.

6. The printing apparatus according to claim 1, wherein the temperature of the print head is adjusted during printing by heating or avoiding heating the print head based on the temperature of the print head.

7. The printing apparatus according to claim 1, wherein the memory for the print head does not hold individual information on the print head.

8. A method for controlling a printing apparatus configured to perform printing using a print head configured to eject ink, the print head being removably installed in the printing apparatus and having a temperature sensor and a memory holding information on a property of the temperature sensor, the method comprising:

a first sensing step of sensing a temperature of the print head using the temperature sensor;

a second sensing step of sensing an environmental temperature of the printing apparatus;

an acquisition step of acquiring information on the property of the temperature sensor held in the memory, at a predetermined timing; and a correction value acquisition step of acquiring a correction value to correct the temperature of the print head sensed in the first sensing step, by comparing the temperature of the print head sensed in the first sensing step with the environmental temperature sensed in the second sensing step, wherein the correction value acquisition step is not performed if first information acquired in the acquisition step after the print head is installed is the same as second information acquired in the acquisition step before the print head is installed.

* * * * *